US011412801B2

(12) United States Patent
Pakula, Jr.

(10) Patent No.: US 11,412,801 B2
(45) Date of Patent: Aug. 16, 2022

(54) NECK SHADE ATTACHMENT FOR BASEBALL CAPS

(71) Applicant: John James Pakula, Jr., Brookfield, MA (US)

(72) Inventor: John James Pakula, Jr., Brookfield, MA (US)

( * ) Notice: Subject to any disclaimer, the term of this patent is extended or adjusted under 35 U.S.C. 154(b) by 0 days.

(21) Appl. No.: 17/060,005

(22) Filed: Sep. 30, 2020

(65) Prior Publication Data

US 2021/0093032 A1 Apr. 1, 2021

Related U.S. Application Data

(60) Provisional application No. 62/907,956, filed on Sep. 30, 2019.

(51) Int. Cl.

| | |
|---|---|
| ***A42B 1/018*** | (2021.01) |
| ***A42B 1/0187*** | (2021.01) |
| ***A42B 1/24*** | (2021.01) |
| ***A42B 1/18*** | (2006.01) |

(52) U.S. Cl.

CPC ..... *A42B 1/0187* (2021.01); *A42B 1/18* (2013.01); *A42B 1/24* (2013.01)

(58) Field of Classification Search

CPC ..... A41B 1/0187; A41B 1/18; A41B 1/24
See application file for complete search history.

(56) References Cited

U.S. PATENT DOCUMENTS

| | | | | | |
|---|---|---|---|---|---|
| 2,055,560 | A * | 9/1936 | Rose | A42B 1/0187 | 2/206 |
| 2,092,808 | A * | 9/1937 | Lipton | A42B 1/22 | 2/183 |
| 2,121,973 | A * | 6/1938 | Lipton | A42B 7/00 | 132/58 |
| 5,153,943 | A * | 10/1992 | Clement | A42B 1/0187 | 2/418 |
| D358,700 | S * | 5/1995 | Porteous | D2/624 | |
| 5,414,903 | A * | 5/1995 | Porteous | A41B 13/10 | 2/49.1 |
| 5,669,074 | A * | 9/1997 | Newman, Jr. | A42B 1/0187 | 2/172 |
| 6,996,852 | B1 * | 2/2006 | Cabrera | A42B 1/24 | 2/172 |
| 7,310,829 | B1 * | 12/2007 | Engel-Wilson | A42B 1/0187 | 2/209.13 |
| 7,343,630 | B2 * | 3/2008 | Lee | A42B 1/0187 | 2/175.6 |
| 7,401,386 | B2 * | 7/2008 | Cannon | A41B 13/10 | 24/298 |
| 8,918,916 | B1 * | 12/2014 | Kang | A42B 1/0187 | 2/175.6 |

(Continued)

*Primary Examiner* — Richale L Quinn

(57) ABSTRACT

A neck shade accessory for baseball caps has a support band, at least one attachment clip, and a sunshade. The support band is adjustable in length and curved to conform to the rear and sides of a baseball cap. Each attachment clip is secured to the support band and clips onto the brim of the baseball cap. The sunshade is terminally attached along the support band and hangs from the rear of the baseball cap to protect a wearer's neck and shoulders from exposure to the sun. A shade attachment of the sunshade may further be incorporated to secure the sunshade to an adjustment band positioned at the rear of the baseball cap.

1 Claim, 4 Drawing Sheets

(56) References Cited

U.S. PATENT DOCUMENTS

| | | | | |
|---|---|---|---|---|
| 9,237,776 | B2 * | 1/2016 | Kang | A42B 1/0187 |
| 2004/0244095 | A1 * | 12/2004 | Sonne | A42B 1/0187 2/175.4 |
| 2006/0117465 | A1 * | 6/2006 | Willows | A45F 5/02 2/338 |
| 2006/0253957 | A1 * | 11/2006 | Orozco | A42B 1/0187 2/171 |
| 2014/0310853 | A1 * | 10/2014 | Miles | A42B 1/0187 2/172 |
| 2015/0059054 | A1 * | 3/2015 | Peterson | A42B 1/0187 2/172 |
| 2016/0113344 | A1 * | 4/2016 | Martin | A42B 1/0187 2/455 |
| 2018/0271195 | A1 * | 9/2018 | Noa | A42B 1/008 |

* cited by examiner

NECK SHADE ATTACHMENT FOR BASEBALL CAPS

The current application claims a priority to the U.S. Provisional Patent application Ser. No. 62/907,956 filed on Sep. 30, 2019.

FIELD OF THE INVENTION

The present invention generally relates to sun protection gear. More specifically, the present invention relates to a sun protection device worn to protect the neck, ears, and a greater area of the face.

BACKGROUND OF THE INVENTION

Today, sun protection gear is in high demand. Sunlight consists of visible and invisible light, such as ultraviolet UVA and UVB rays. UVA rays cause skin aging and wrinkling and contribute to skin cancer, for example, melanoma. UVB rays cause sunburns, cataracts, and immune system damage. Moreover, sunlight that is not reflected is absorbed and converted to heat, thus warming those directly exposed to the sunlight, making shade desirable. Sunscreens need to be applied prior to being in direct sunlight, and water-resistant sunscreens are detrimentally affected by washing off with perspiration or swimming, and must be reapplied frequently, at least every 90 minutes.

Significant protection for the face and neck may be achieved by wearing a hat with a brim that shades the face, ears, and back of the neck. Unfortunately, this type of hat is not very popular. Most people prefer to wear baseball caps of their choice, which offers sun protection for the forehead, but affords no sun protection for the back of the neck, ears, and a greater portion of the face.

In light of the above, a need exists for an inexpensive and user-friendly sun protection device that can be worn in conjunction with a baseball cap to avoid the above-mentioned sun exposure issues to the neck, ears, and face and the inadequacies of current headgear. The present invention seeks to provide a new and improved sun protection device with unique, simple and inexpensive construction.

Additional advantages of the invention will be set forth in part in the description which follows, and in part will be obvious from the description, or may be learned by practice of the invention. Additional advantages of the invention may be realized and attained by means of the instrumentalities and combinations particularly pointed out in the detailed description of the invention section. Further benefits and advantages of the embodiments of the invention will become apparent from consideration of the following detailed description given with reference to the accompanying drawings, which specify and show preferred embodiments of the present invention.

DETAIL DESCRIPTIONS OF THE INVENTION

Figure 1:
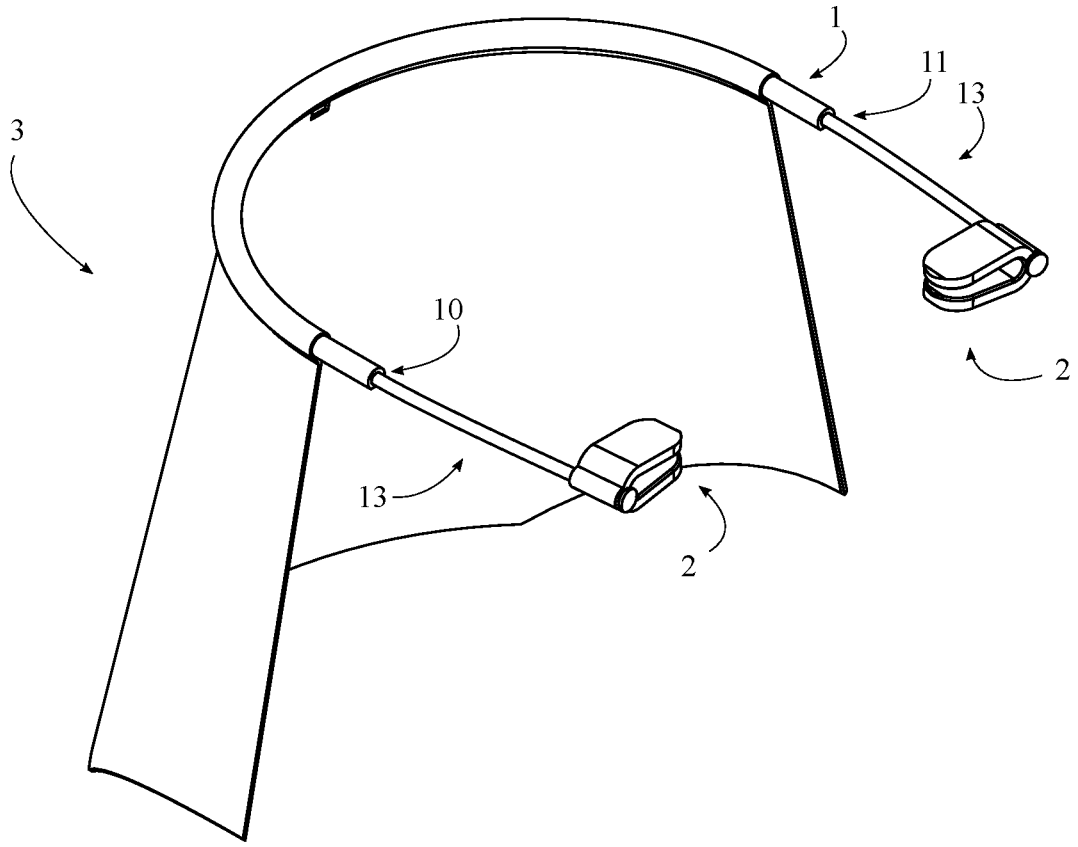
FIG. 1 is a front perspective view of the present invention.
Figure 2:
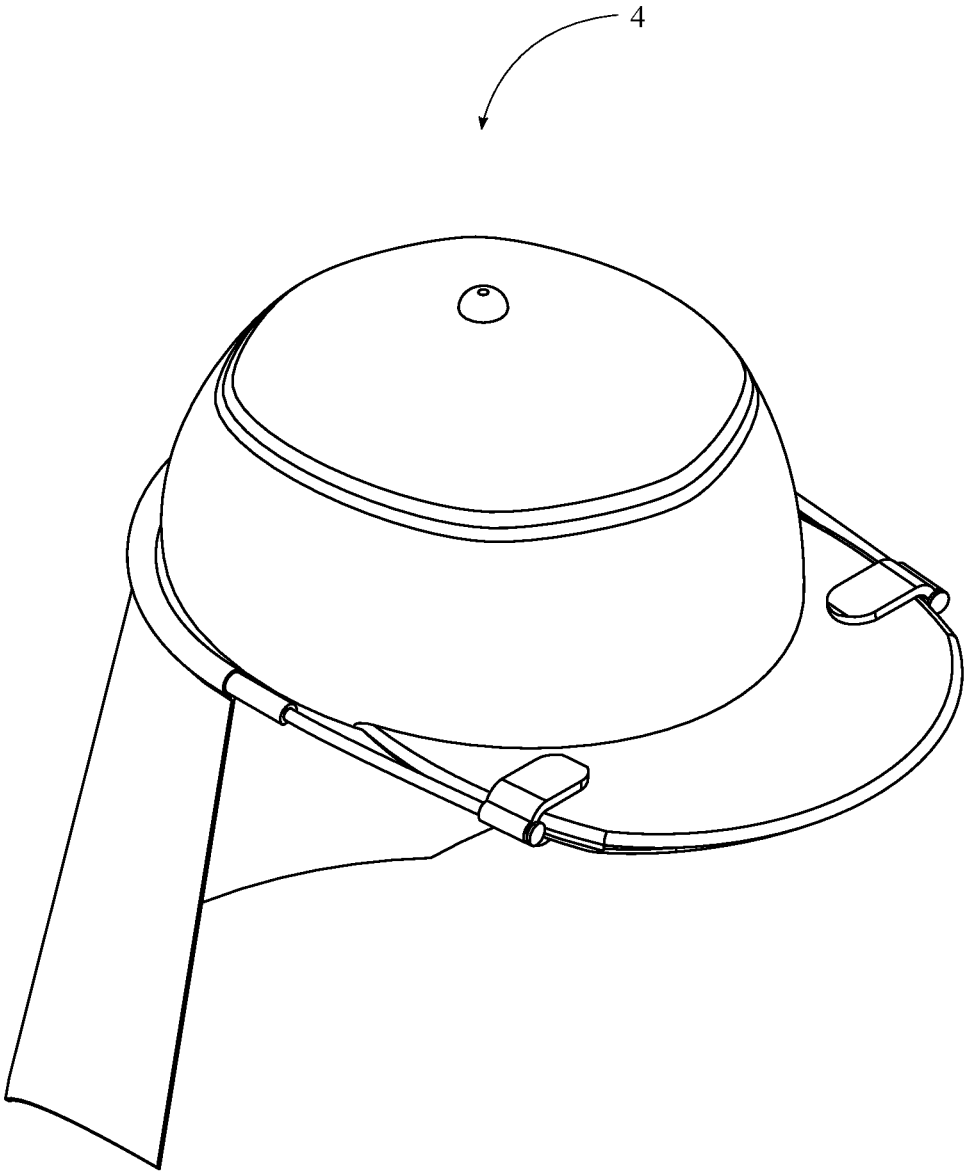
FIG. 2 is a front perspective view of the present invention attached to a baseball cap.
Figure 3:
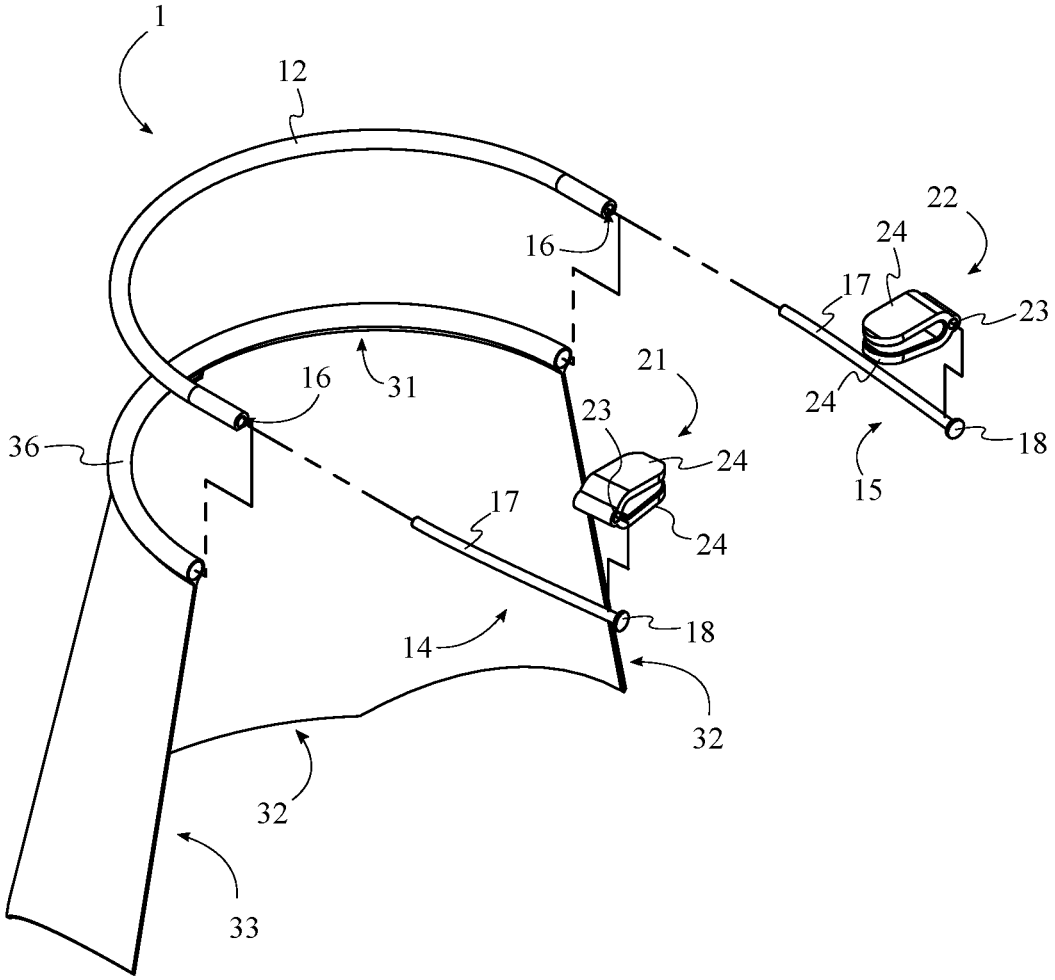
FIG. 3 is a front perspective exploded view of the present invention.

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

The present invention provides a sun protection device that can be quickly and easily affixed to almost any baseball cap and can be quickly and easily detached from the baseball cap when not needed.

In general, as shown in FIGS. 1-4, the present invention comprises a support band 1, at least one attachment clip 2, and a sunshade 3. In the preferred embodiment of the present invention, the support band 1 has curvilinear geometry, being generally rounded, or U-shaped, in order to perimetrically conform to a baseball cap 4, more particularly the rear and sides of a baseball cap 4. The curved shape of the support band 1 is such that when attached to the baseball cap 4, the majority of the tension of the support band 1 will be present at the sides of the brim, and not on the wearer's head.

The support band 1 extends between a first end 10 and a second end 11, and is adjustable in length between the first end 10 and the second end 11. The at least one attachment clip 2 is attached to the support band 1, wherein the at least one attachment clip 2 is configured to removably attach the support band 1 to a baseball cap 4. The sunshade 3 is terminally attached along the support band 1 between the first end 10 and the second end 11 of the support band 1 so that the sunshade 3 hangs from the support band 1 while in use to shade the neck, ears, and portions of the face and shoulders of a user. The support band 1 and the at least one attachment clip 2 may be manufactured of any suitable material, including, but not limited to, plastic, metal, rubber, wood, or any combination of materials as desired. The sunshade 3 may be manufactured from any desired fabric, textile, or other suitable flexible or rigid material as desired in various embodiments.

The support band 1 wraps around the sides and back of a baseball cap 4, with the first end 10 and the second end 11 being positioned laterally adjacent to a brim of the baseball cap 4. Preferably, the at least one attachment clip 2 comprises a pair of attachment clips, which are positioned at the ends of the support band 1 and clip onto the brim of the baseball cap 4, affixing the support band 1 in place on the baseball cap 4. The sunshade 3, therefore, being attached to the support band 1, is supported around the back of the baseball cap 4 and therefore, when the present invention is affixed to a baseball cap 4 worn by a user, provides shade to the back and sides of the user's neck, ears, and, to some degree, their face, shoulders and back, depending on the dimensions of the sunshade 3, which may vary as desired in different embodiments.

As previously stated, in the preferred embodiment of the present invention, the support band 1 is adjustable in length in order to accommodate various sizes of baseball caps or various other types of headwear. It is contemplated that this may be accomplished through a variety of means; however, in the preferred embodiment, the support band 1 comprises a band body 12 and at least one adjustment portion 13. Each of the at least one adjustment portion 13 is adjustably attached along the band body 12, wherein the length of the support band 1 between the first end 10 and the second end 11 is adjustable through selectable positioning of the at least one adjustment portion 13 along the band body 12.

In the preferred embodiment, the at least one attachment clip 2 comprises a first attachment clip 21 and a second attachment clip 22. The first attachment clip 21 is positioned adjacent to the first end 10 of the support band 1, and the second attachment clip 22 is positioned adjacent to the second end 11 of the support band 1. The first attachment clip 21 and the second attachment clip 22 serve to affix the ends of the support band 1 to opposing lateral sides of the brim of the baseball cap 4. It is contemplated that in various embodiments, the first attachment clip 21 and the second attachment clip 22 may take many different forms, so long as they are capable of establishing a reasonably firm connection between the support band 1 and the baseball cap 4. It is further contemplated that in various embodiments, the at least one attachment clip 2 may vary in count and location. It is further contemplated that in some embodiments, means other than clips may be utilized to affix the support band 1 to the baseball cap 4 or other headwear; for example, button snaps, mating protrusions on the support band 1 and holes on the headwear, hook and loop tape, or other means. However, it is understood that such alternative fastening means require modification of the headwear, while the use of clips in the preferred embodiment of the present invention allows attachment to any typical baseball cap 4 without such modification to the headwear. In some embodiments, the first attachment clip 21 and the second attachment clip 22 may be spring loaded to ensure a firm grip on the brim.

In the preferred embodiment, the support band 1 more specifically comprises a band body 12, a first adjustment portion 14, and a second adjustment portion 15, while the at least one attachment clip 2 comprises the first attachment clip 21 and the second attachment clip 22 as previously discussed. The first adjustment portion 14 is slidably engaged with the band body 12, and the first attachment clip 21 is attached to the first adjustment portion 14 opposite the band body 12 along the first adjustment portion 14. Similarly, the second adjustment portion 15 is slidably engaged with the band body 12 opposite the first adjustment portion 14 along the band body 12, and the second attachment clip 22 is attached to the second adjustment portion 15 opposite the band body 12 along the second adjustment portion 15.

More specifically, the first adjustment portion 14 and the second adjustment portion 15 are each slidably positioned within the band body 12. To this end, the band body 12 comprises an internal channel 16 that traverses centrally through the band body 12 along the entire length of the band body 12, forming a tube-like structure. Alternatively, the band body 12 may comprise two separate internal channels that traverse into the ends of the band body 12 to a sufficient extend to accommodate the lengths of the adjustment portions. The first adjustment portion 14 and the second adjustment portion 15 are inserted into the internal channel 16 at opposite ends of the band body 12. Preferably, the first adjustment portion 14 and the second adjustment portion 15 are free to slide within the internal channel 16, though it is contemplated that some embodiments may further comprise a means to secure the first adjustment portion 14 and the second adjustment portion 15 in a fixed location along the internal channel 16. For example, a tightening mechanism may be integrated into the band body 12, wherein the tightening mechanism may be engaged in order to secure the first adjustment portion 14 and the second adjustment portion 15 in place through friction.

In various embodiments, the means and nature of attachment of the first attachment clip 21 and the second attachment clip 22 to the support band 1 may vary. However, in the preferred embodiment, the first attachment clip 21 is rotatably attached to the first adjustment portion 14, and the second attachment clip 22 is rotatably attached to the second adjustment portion 15. The rotational attachment of the attachment clips to the support band 1 is desired in order to facilitate attachment to the brim of the baseball cap 4 while allowing for differences in orientation of the brim, since different users may have different preferences and may form the brim into different geometrical configurations or purchase headwear with such differing geometrical configurations. For example, some users may prefer a flat brim, while other users may prefer a rounded brim.

Further, in the preferred embodiment, the first adjustment portion 14 and the second adjustment portion 15 each comprise an adjustment body 17 and an end stop 18. The end stop 18 is terminally connected to the adjustment body 17 for each of the first adjustment portion 14 and the second adjustment portion 15. The end stops 18 function to keep the attachment clips from falling off the terminal ends of the attachment bodies.

Further, in the preferred embodiment, the first attachment clip 21 and the second attachment clip 22 each comprise a band attachment 23 and a pair of clip arms 24. The pair of clip arms 24 is terminally connected to each other adjacent to the band attachment 23 for each of the first attachment clip 21 and the second attachment clip 22. The adjustment body 17 of the first adjustment portion 14 is engaged with the band attachment 23 of the first attachment clip 21, wherein the first attachment clip 21 is positioned between the end stop 18 of the first adjustment portion 14 and the band body 12. Similarly, the adjustment body 17 of the second adjustment portion 15 is engaged with the band attachment 23 of the second attachment clip 22, wherein the second attachment clip 22 is positioned between the end stop 18 of the second adjustment portion 15 and the band body 12. Preferably, the band attachment 23 is a through hole, though it may be understood that the band attachment 23 may vary in different embodiments.

The sunshade 3 is a generally flat, flexible portion of cloth, fabric, or textile. The shape of the sunshade 3 may vary in different embodiments, but generally should be large enough to cover the user's neck, ears, and portions of the face and shoulders while in use without impairing the user's field of vision. In some embodiments, the sunshade 3 has a generally rectangular shape with its two bottom corners cut to accommodate the user's shoulders. In the preferred embodiment, the sunshade 3 comprises a top edge 31, a bottom edge 32, a first lateral edge 33, and a second lateral edge 34. The sunshade 3 is perimetrically delineated by the top edge 31, the bottom edge 32, the first lateral edge 33, and the second lateral edge 34. The top edge 31 and the bottom edge 32 laterally traverse between the first lateral edge 33 and the second lateral edge 34, and are positioned opposite each other along the first lateral edge 33 and the second lateral edge 34.

It should be understood that the means of attachment of the sunshade 3 to the support band 1 may vary in different embodiments. In the preferred embodiment, the sunshade 3 is attached to the support band 1 in a manner similar to a curtain hanging from a curtain rod. To this end, the sunshade 3 comprises a casing 36. The casing 36 may be understood to be a closed loop of fabric formed by a hem adjacent to the top edge 31 of the sunshade 3. The casing 36 perimetrically traverses along the sunshade 3 adjacent to the top edge 31 of the sunshade 3, and the support band 1 is removably positioned within the casing 36.

To assemble the present invention in the preferred embodiment, a user inserts one end of the band body 12 into one end of the casing 36 and compresses the remainder of the casing 36 onto the band body 12 until the other end of the band body 12 emerges from the other end of the casing 36, such that the two opposing ends of the band body 12 protrude from the two opposing ends of the casing 36. The user then inserts the ends of the attachment bodies of the adjustment portions opposite the end stops 18 first through the band attachments 23 of the attachment clips, then into the internal channel 16 at the exposed ends of the band body 12. The present invention is then ready to be attached to a baseball cap 4 by sliding the open ends of the attachment arms onto laterally opposing sides of the brim of the baseball cap 4.

Figure 4:
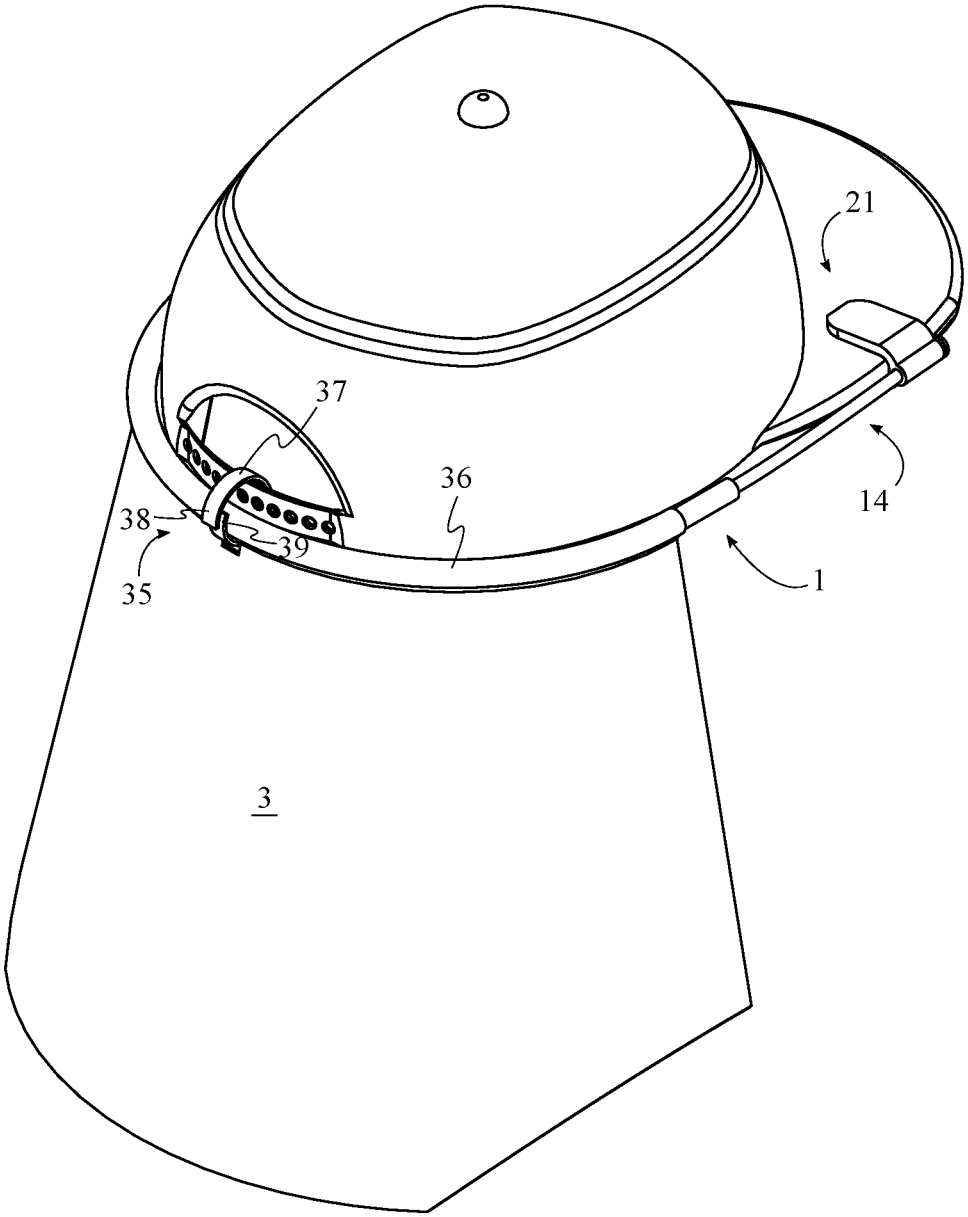
FIG. 4 is a rear perspective view of the present invention attached to a baseball cap.

In addition to the attachment clips, which serve as the main points of attachment of the present invention to a baseball cap 4, the preferred embodiment of the present invention preferably further incorporates a third attachment point at the rear of the baseball cap 4 to ensure the present invention is properly secured in place. To this end, as shown in FIG. 4, the sunshade 3 further comprises a shade attachment 35 that is positioned laterally centered on the sunshade 3, equidistant between the first lateral edge 33 and the second lateral edge 34. It should be understood that the specific configuration of the shade attachment 35 of the sunshade 3 may vary; however, in the preferred embodiment, the shade attachment 35 comprises a flexible member 37, a first attachment portion 38, and a second attachment portion 39. The flexible member 37 is connected to the sunshade 3 adjacent to the top edge 31 of the sunshade 3. The first attachment portion 38 and the second attachment portion 39 are connected to the flexible member 37 and positioned opposite each other along the flexible member 37. The first attachment portion 38 and the second attachment portion 39 are removably attached to each other, such that the flexible member 37 forms a closed loop when the first attachment portion 38 and the second attachment portion 39 are attached to each other.

Many baseball caps 4 incorporate a closure at the rear of the cap to allow fit adjustment, comprising an adjustment strap adjacent to an opening. The shade attachment 35 of the sunshade 3 is intended to be affixed around the adjustment strap through the opening, thus securing the sunshade 3 to the adjustment strap, and together with the two attachment clips at the brim, forming three points of attachment in a triangular arrangement, promoting secure attachment of the present invention to the baseball cap 4. In some embodiments, the shade attachment 35 is a hook and loop fastener, such that the first attachment portion 38 is a hook portion of the hook and loop fastener and the second attachment portion 39 is a loop portion of the hook and loop fastener, or vice versa. In some embodiments, the shade attachment 35 may incorporate one or more button snaps.

Although the invention has been explained in relation to its preferred embodiment, it is to be understood that many other possible modifications and variations can be made without departing from the spirit and scope of the invention as hereinafter claimed.

What is claimed is:

1. A neck shade attachment for baseball caps comprising:

a support band comprising a band body, a first adjustment portion, and a second adjustment portion;

at least one attachment clip comprising a first attachment clip and a second attachment clip;

a sunshade comprising a shade attachment;

the support band extending between a first end and a second end;

the support band being adjustable in length between the first end and the second end;

the at least one attachment clip being attached to the support band, wherein the at least one attachment clip is configured to removably attach the support band to a baseball cap;

the sunshade being terminally attached along the support band between the first end and the second end;

the support band having curvilinear geometry, wherein the support band is shaped to perimetrically conform to a baseball cap;

each of the at least one adjustment portion being adjustably attached along the band body, wherein the length of the support band between the first end and the second end is adjustable through selectable positioning of the at least one adjustment portion along the band body;

the first attachment clip being positioned adjacent to the first end of the support band;

the second attachment clip being positioned adjacent to the second end of the support band;

the first attachment clip being rotatably attached to the first adjustment portion opposite the band body along the first adjustment portion;

the second attachment clip being rotatably attached to the second adjustment portion opposite the band body along the second adjustment portion;

the first attachment clip and the second attachment clip each comprising a band attachment and a pair of clip arms;

the first adjustment portion being slidably engaged with the band body;

the second adjustment portion being slidably engaged with the band body opposite the first adjustment portion along the band body;

the first adjustment portion and the second adjustment portion being slidably positioned within the band body;

the first adjustment portion and the second adjustment portion each comprising an adjustment body and an end stop;

the adjustment body of the first adjustment portion being engaged with the band attachment of the first attachment clip, wherein the first attachment clip is positioned between the end stop of the first adjustment portion and the band body;

the adjustment body of the second adjustment portion being engaged with the band attachment of the second attachment clip, wherein the second attachment clip is positioned between the end stop of the second adjustment portion and the band body;

the first attachment portion and the second attachment portion being connected to the flexible member and positioned opposite each other along the flexible member;

the first attachment portion and the second attachment portion being removably attached to each other, wherein the flexible member forms a closed loop when the first attachment portion and the second attachment portion are attached to each other;

the end stop being terminally connected to the adjustment body for each of the first adjustment portion and the second adjustment portion;

the pair of clip arms being terminally connected to each other adjacent to the band attachment for each of the first attachment clip and the second attachment clip;

the sunshade comprising a top edge, a bottom edge, a first lateral edge, and a second lateral edge;

the sunshade being perimetrically delineated by the top edge, the bottom edge, the first lateral edge, and the second lateral edge;

the sunshade comprising a casing;

the top edge and the bottom edge laterally traversing between the first lateral edge and the second lateral edge;

the top edge and the bottom edge being positioned opposite each other along the first lateral edge and the second lateral edge;

the shade attachment being positioned laterally centered on the sunshade;

the shade attachment comprising a flexible member, a first attachment portion, and a second attachment portion;

the flexible member being connected to the sunshade adjacent to a top edge of the sunshade;

the shade attachment being a hook and loop fastener;

the casing and perimetrically traversing along the sunshade adjacent to a top edge of the sunshade; and the support band being removably positioned within the casing.

* * * * *